United States Patent [19]

Przybylinski et al.

[11] 4,334,481

[45] Jun. 15, 1982

[54] FATIGUE RESISTANT PARTITION SHEET ASSEMBLY

[75] Inventors: Phillip Przybylinski, Schererville, Ind.; Babgaunda A. Patil, Birmingham, Ala.; Gerald B. Anderson, Evergreen Park, Ill.

[73] Assignee: Pullman Incorporated, Chicago, Ill.

[21] Appl. No.: 144,753

[22] Filed: Apr. 28, 1980

[51] Int. Cl.[3] ..... B61D 7/00

[52] U.S. Cl. ..... 105/248; 105/406 R

[58] Field of Search ..... 105/247, 248, 358, 360, 105/404, 406 R; 298/8 H, 24, 27; 280/5 C, 5 D, 5 E; 220/22; 52/45-56

[56] References Cited

U.S. PATENT DOCUMENTS

| | | | |
|---|---|---|---|
| 3,572,252 | 3/1971 | Coover et al. | 105/248 |
| 3,583,331 | 6/1971 | Mowatt-Larssen | 105/248 X |
| 3,789,773 | 2/1974 | McNally et al. | 105/248 |
| 4,262,602 | 4/1981 | Patil et al. | 105/248 |

*Primary Examiner*—Randolph A. Reese

*Attorney, Agent, or Firm*—Richard J. Myers

[57] ABSTRACT

A covered railway hopper car includes a partition sheet assembly, including a plurality of partition sheets compartmentalizing the hopper car. The partion sheets include a construction at their upper end which relieves stress, reduces fatigue and improves partition sheet resistance to fatigue.

10 Claims, 8 Drawing Figures

FATIGUE RESISTANT PARTITION SHEET ASSEMBLY

BACKGROUND OF THE INVENTION

1. Field of the Invention

The invention relates generally to railway hopper cars and more particularly concerns partition sheet assemblies.

2. Description of the Prior Art

Partition sheet assemblies divide covered railroad hopper cars into compartments. The partition sheet assemblies are attached at their upper portions to overhead framing members, usually by welding. When the partition sheet assemblies are subjected to a force they are caused to flex. Under cyclic flexing, hard spots and stress concentrations build in the partition sheet assemblies at their upper portions culminating in fatigue fractures.

Accordingly, it is the primary aim of this invention to improve fatigue resistance of partition sheet assemblies under cyclic flexing, while still allowing the partition sheet assemblies to act as roof support elements and stiffening elements for the top framing bar.

A further aim of this invention is to provide greater attachmennt strength of partition sheet assemblies to the top framing bar.

The present invention includes a plurality of embodiments, each of which is an improvement over the prior art, in that each includes a construction at the upper ends of partition sheet assemblies, which improves partition sheet resistance to fatigue cracking under cyclic loading.

SUMMARY OF THE INVENTION

In accordance with the invention, railway hopper cars include a plurality of partition sheet assemblies. These partition sheet assemblies extend vertically within the hopper car and are fixedly connected at their upper ends to a top framing bar. The partition sheet assemblies act as compartment dividers, roof support elements, stiffening members and load restraining devices.

The forces created during the coupling-uncoupling operation of railway vehicles and during acceleration, cause loads which the partition sheet assembly must restrain. To restrain the loads, each partition sheet assembly flexes, much like a membrane. Since the partition sheet assembly is rigidly attached to the top framing bar, the bar must rotate in unison with the partition sheet or create a bending movement in the partition sheet. It is the rotation of the top framing bar which reduces the bending movement in the partition sheet thereby reducing stress concentration and preventing fatigue fractures.

The top framing bar is prevented from rotating in the area of its intersection with the roof step, upstanding coaming and hatch opening. This causes a bending movement in the partition sheet assembly below that area causing a high degree of stress concentration leading to premature fatigue cracking under cyclic flexing.

To improve the fatigue characteristics in partition sheet assemblies, a bar or plate, thicker than the partition sheet, is attached to the top framing bar. The plate is also attached to the partition sheet. Further, one method rivets the upper portion of the partition sheet to the lower portion of the plate. This places a thick construction with better fatigue properties in the area of the maximum movement to resist stress buildup and withstand fatigue fractures. Also, the partition sheet is not attached to the top framing bar but lies below it. The plate extends from sidewall to sidewall.

Another method for improving resistance to fatigue cracks in partition sheet assemblies is to attach a bar or plate to the upper portion of the partition sheet by rivets. The plate and partition sheet are welded to the top framing bar. The plate extends between points located just outward of the roof steps.

An additional method for improving fatigue resistance involves a plurality of plates or bar welded to the partition sheet and welded to the top framing bar. These plates would be located in the areas of the roof step portion and upstanding coaming of the hopper car. The plates would extend into the area of the maximum movement produced by partition sheet flexing.

While the invention will be described in connection with preferred embodiments, it will be understood that it is not intended to limit this invention to the embodiment. On the contrary, it is intended to cover all alternatives, modifications, and equivalents as may be included in the spirit and scope of the invention as defined by the appended claims.

DESCRIPTION OF THE PREFERRED EMBODIMENTS

Figure 1:
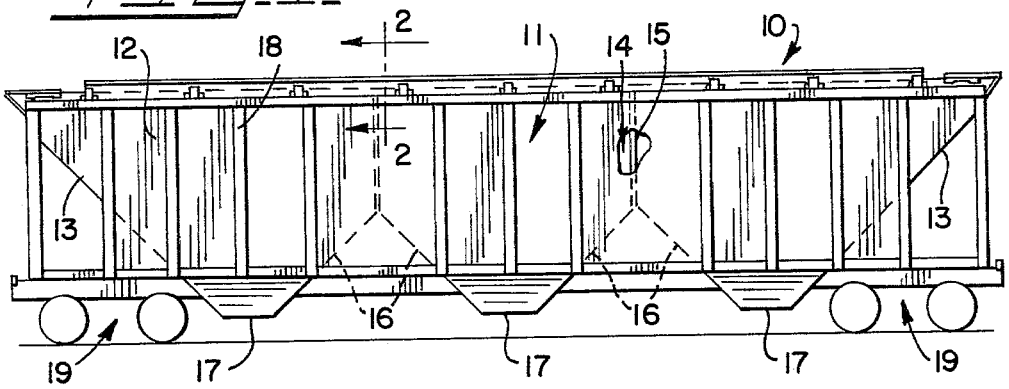
FIG. 1 is a side elevational view of a covered railway hopper car.

Referring to FIG. 1 there is shown a covered railway hopper car designated by reference numeral 10. The covered railway hopper car 10 includes a car body 11 having sidewalls 12. Connected to opposite ends of the sidewalls 12 are end walls 13 which slope downwardly. The hoppers 14 include partition sheet assemblies 15 and downwardly sloping sheets 16 leading to discharge openings 17. The sidewalls 12 are also provided with the usual type side posts 18. The car body 11 is supported on conventional wheel trucks generally designated at 19.

Figure 2:
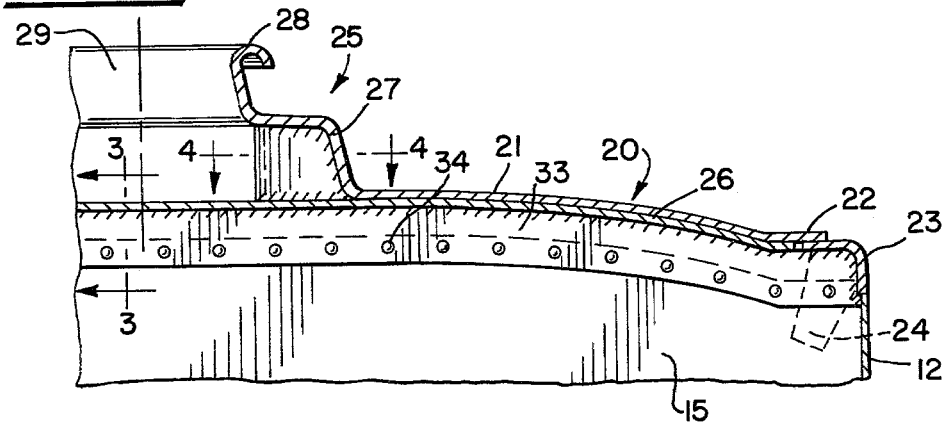
FIG. 2 is a section taken along line 2—2 of FIG. 1.
Figure 5:
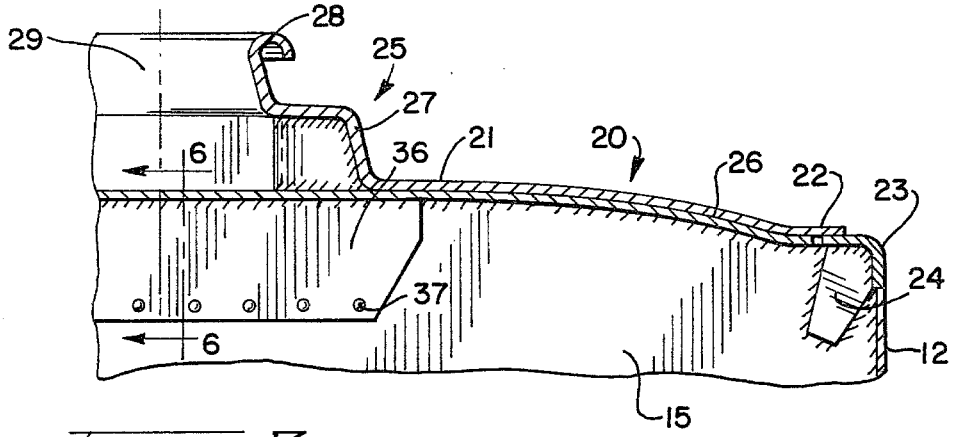
FIG. 5 is another embodiment of the invention taken substantially along line 2—2 of FIG. 1.
Figure 7:
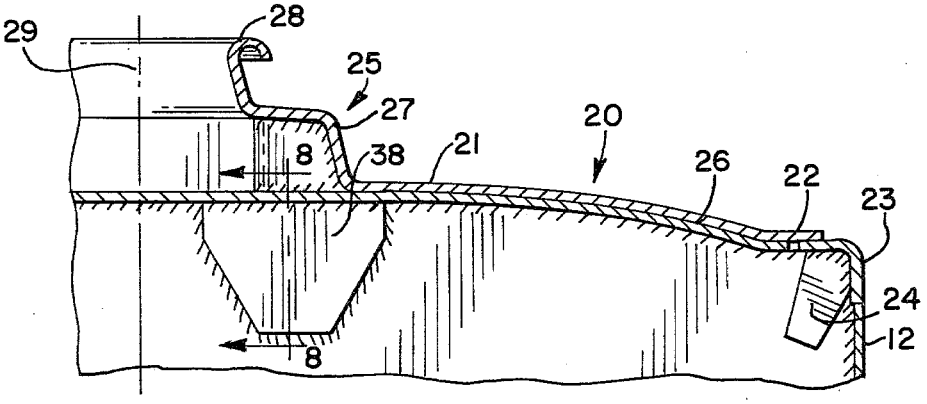
FIG. 7 is another embodiment of the invention taken substantially along line 2—2 of FIG. 1.

As best shown in FIGS. 2, 5 and 7, a roof is generally designated at reference numeral 20. The roof 20 consists of a roof sheet 21 having flanges 22 at the outer ends. The flanges 22 are connected to top side plates 23 which are connected to the side wall 12; gussets 24 are used to secure partition sheet 15 to top side plate 23. The roof sheet extends laterally from its flanges 22 inwardly to a roof step and upstanding coaming area generally designated at 25. The roof sheet 21 is attached to a top framing bar 26. A roof step portion 27 rises into an upstanding coaming 28 including an elongated hatch opening 29.

Figure 4:
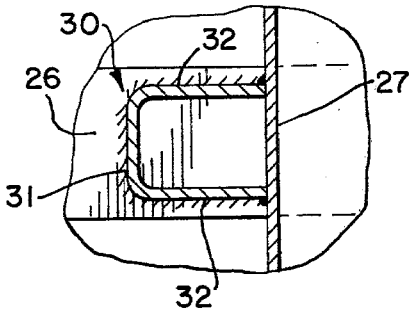
FIG. 4 is a section taken along line 4—4 of FIG. 2.

FIG. 4 depicts a U-shaped shield generally designated as 30. The U-shaped shields are elements having a central flange 31 and laterally spaced leg members 32 connected to the central flange 31. The U-shaped shields 30 are welded to the top framing bar 26 having the central flange 31 adjacent to the hatch opening 29 and the laterally spaced leg members 32 within the roof step portion 27. The U-shaped shields 30 prevent the collection of material along the top framing bar 26 beneath the roof step and upstanding coaming area 25.

Figure 3:
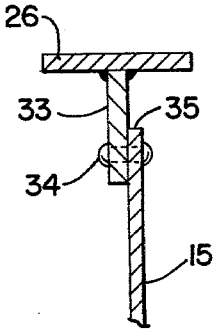
FIG. 3 is a section taken along line 3—3 of FIG. 2.

FIGS. 2 and 3 show means for fatigue resistance in the form of a doubler plate 33 welded at its upper end portion to the underneath portion of the top framing bar 26. The doubler plate 33 extends laterally between the sidewalls 12 beneath the top framing bar 26. The lower end portion of the doubler plate 33 is fixedly attached to the upper end portion of the partition sheet assembly 15 by means of mechanical fasteners or rivets 34. This leaves the upper edge 35 of the partition sheet assembly 15 unattached and places it substantially adjacent to and beneath the top framing bar 26 in an area of low bending.

Figure 6:
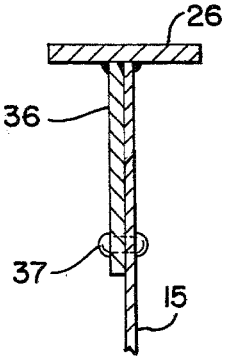
FIG. 6 is a section taken along 6—6 of FIG. 5.

In FIGS. 5 and 6, another embodiment of the invention is shown. This construction has means for fatigue resistance wherein a doubler plate 36 is welded at its upper end portion to the underneath portion of the top framing bar 26. The partition sheet assembly 15 lies adjacent to and abuts the doubler plate 36. The upper edge (not shown) of the partition sheet assembly abuts the underneath portion of the top framing bar 26. The partition sheet assembly 15 is welded at its upper end portion to the underneath portion of the top framing bar. The doubler plate 36 and partition sheet assembly are fastened together by rivets 37. The rivets being placed at the lower end portion of the doubler plate 36. The doubler plate extends between points just outward of the area of opposing roof sheet rising into roof step portions. The doubler plate 37 extends below the top framing bar 26 to be in an area of the partition sheet assembly 15 experiencing low bending forces.

Figure 8:
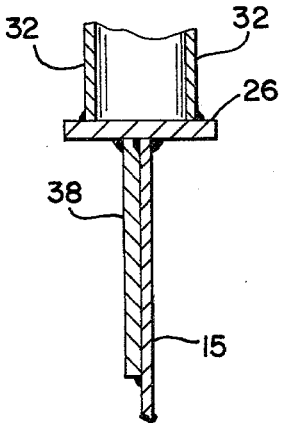
FIG. 8 is a section taken along line 8—8 of FIG. 7.

Further in FIGS. 7 and 8 the embodiment details a plurality of doubler plates 38 (only one shown). The doubler plates 38 are welded at their upper end portion to the underneath of the top framing bar 26 as is the partition sheet assembly 15. The doubler plates 38 abut and are adjacent to the partition sheet assembly 15 and extend below the top framing bar 26 into an area of the partition sheet assembly 15 experiencing low bending forces. The doubler plates 38 are located between a point just below the roof sheet as it rises into the roof step portion and a point just inward of the upstanding coaming. The doubler plates 38 are welded around its periphery to the partition sheet assembly 15.

As the partition sheet assembly 15 flexes under loads it tends to rotate the top framing bar 26. In the areas where the top framing bar 26 rotates the partition sheet assemblies 15 have greater fatigue resistance, but in areas where the top framing bar 26 is inhibited from rotation, such as the roof step portion 27 and upstanding coaming 28 premature fatigue cracks develop in the partition sheet assemblies 15. The above described embodiments show various means for fatigue resistance 33, 36 and 38 which provide thicker constructions in the area of maximum bending forces to inhibit premature fatigue cracking under cyclic loading.

Thus it is apparent that there has been provided in accordance with the invention, embodiments that fully satisfy the objects, aims and advantages set forth above. While the invention has been described in conjunction with specific embodiments thereof, it is evident that many alternatives, modifications and variations will be apparent to those skilled in the art in light of the foregoing description. Accordingly, it is intended to enhance all such alternatives, modifications and variations as set forth within the spirit and broad scope of the appended claims.

What is claimed is:

1. A railway hopper car including a body having sidewalls, a hopper, and a roof sheet including flanges at its outer edges connected to the sidewalls, said roof sheet including an elongated roof step portion having an upstanding coaming defining an elongated hatch opening, and a transversely extending top framing bar connected to and beneath said roof sheet, the improvement comprising:

a partition sheet assembly extending vertically within said hopper, means for connecting said partition sheet assembly at its upper end portion to said top framing bar, said means for connecting including a means for fatigue resistance, said fatigue resistance means comprising plate means extending transversely beneath said roof step portion and said hatch opening, said plate means including a top edge portion weldingly connected to said top framing bar and a bottom edge portion connected to said partition sheet assembly by mechanical fastener means whereby fatigue stress in said connecting means outwardly of said hatch opening is reduced to improve resistance to premature fatigue cracking of said partition sheet assembly.

2. The invention in accordance with claim 1, and said means for fatigue resistance being thicker than said partition sheet assembly.

3. The invention in accordance with claim 1, and said mechanical fastener means comprising rivets for connecting said means for fatigue resistance at its lower end portion to said partition sheet assembly upper end portion.

4. The invention in accordance with claim 1 or 3, and said upper end portion of said partition sheet assembly being spaced from and disposed beneath the top framing bar.

5. The invention in accordance with claim 4, and said means for fatigue resistance extending transversely of said car, from sidewall to sidewall.

6. The invention in accordance with claim 3, and said partition sheet assembly upper end portion including an upper edge portion and, said partition sheet assembly being welded to said top framing bar at said upper edge portion.

7. The invention in accordance with claim 1, and said partition sheet assembly upper end portion including an upper edge portion, said partition sheet assembly being welded to said top framing bar at said upper edge portion, and said means for fatigue resistance being in overlapping abutting relation to said partition sheet assembly.

8. The invention in accordance with claim 7, and said means for fatigue resistance being spaced from said sidewalls, and said mechanical fastener means comprising rivets connecting said partition sheet assembly to said fatigue resistance means.

9. A railway hopper car having a body including spaced sidewalls, a roof sheet extending between and respectively connected to said sidewalls, and a top framing bar connected to and extending beneath said roof sheet, said sidewalls and roof sheet defining a hopper, and said roof sheet including an elongated roof step portion having an upstanding coaming defining an elongated hatch opening, the improvement comprising:

a partition sheet assembly extending vertically within said hopper, the upper end portion of said partition sheet assembly abutting and being connected to said top framing bar, and fatigue resistance means connecting said partition sheet assembly and said top framing bar comprising a pair of spaced apart plate means each fixedly connected to said partition sheet assembly and said top framing bar and respectively disposed beneath said roof step portion of said roof sheet, whereby fatigue stress is reduced in areas disposed outwardly of an area of relatively low bending stress generally disposed beneath said hatch opening, to improve resistance to premature fatigue cracking of said partition sheet assembly.

10. The invention in accordance with claim 9, wherein said plate means are welded to said partition sheet assembly and said top framing bar.

* * * * *